US005845776A

United States Patent [19]

Galbierz et al.

[11] Patent Number: 5,845,776

[45] **Date of Patent: *Dec. 8, 1998**

[54] MULTI-PACK CARRIER FOR BOTTLES

[75] Inventors: Richard T. Galbierz; Michael A. Galbierz, both of St. Louis, Mo.

[73] Assignee: Eco-Pak Products, Inc., St. Louis, Mo.

[ * ] Notice: The term of this patent shall not extend beyond the expiration date of Pat. No. 5,590,776.

[21] Appl. No.: 895,055

[22] Filed: Jul. 16, 1997

[51] Int. Cl.[6] ..... B65D 75/00

[52] U.S. Cl. ..... 206/427; 206/153; 206/155

[58] Field of Search ..... 206/427, 153, 206/155, 158

[56] References Cited

U.S. PATENT DOCUMENTS

| | | |
|---|---|---|
| 2,298,209 | 10/1942 | Gray . |
| 2,437,667 | 3/1948 | Smith . |
| 2,654,474 | 10/1953 | Ringler . |
| 3,038,600 | 6/1962 | Powell . |
| 3,038,602 | 6/1962 | Rapata . |
| 3,137,109 | 6/1964 | Rapata . |
| 3,139,981 | 7/1964 | Akeireb . |
| 3,156,358 | 11/1964 | Randrup . |
| 3,281,180 | 10/1966 | Spery . |
| 3,317,234 | 5/1967 | Burford . |
| 3,331,500 | 7/1967 | Poupitch . |
| 3,383,827 | 5/1968 | Schaich . |
| 3,394,800 | 7/1968 | Brackett et al. . |
| 3,454,157 | 7/1969 | Kulig . |
| 3,528,697 | 9/1970 | Wood . |
| 3,601,439 | 8/1971 | Poupitch . |
| 3,897,873 | 8/1975 | Graser . |
| 3,926,307 | 12/1975 | Klygis . |
| 4,064,989 | 12/1977 | Olsen . |
| 4,109,787 | 8/1978 | Klygis et al. . |
| 4,180,191 | 12/1979 | Wood . |
| 4,190,149 | 2/1980 | Oliff et al. . |
| 4,273,273 | 6/1981 | Zenri . |
| 4,305,500 | 12/1981 | Jaeschke . |
| 4,318,476 | 3/1982 | Wood et al. . |
| 4,326,628 | 4/1982 | Wood . |

(List continued on next page.)

FOREIGN PATENT DOCUMENTS

| | | |
|---|---|---|
| 686614 | 5/1964 | Canada . |
| 0048506 | 3/1982 | European Pat. Off. . |
| 2363493 | 2/1977 | France . |
| 7130796 | 8/1971 | Germany . |
| 2085391 | 5/1984 | United Kingdom . |

*Primary Examiner*—David T. Fidel
*Attorney, Agent, or Firm*—Polster, Lieder, Woodruff & Lucchesi

[57] ABSTRACT

A box-top carrier includes a top panel, a bottom panel spaced from the top panel, and two side panels extending between the top and bottom panels. The carrier is provided with a release mechanism to facilitate removal of bottles from the carrier. The top panel has apertures through which the bottle necks extend and a plurality of slits extending from an edge of the apertures to define a plurality of tabs around the apertures. The bottom panel has a plurality of apertures which are generally concentric with the top panel apertures. The top and bottom panel apertures are formed in an array having at least two columns of at least two spaced apart rows. The release mechanism includes pairs of tear lines in the top panel extending from the edges of the top panel to slits of the top panel apertures. The pairs of tear lines include two spaced apart tear lines which define tear strips extending between the top panel apertures. When a tear strip is pulled, the strip forms a space between the columns of apertures in the top panel and a gap in the top panel apertures which places the top panel apertures in communication with the space. In another embodiment, the tear strips are defined by tear lines which extend diagonally from a finger hole of the carrier to the adjacent apertures in the top panel. A further embodiment of the tear strips allows for releasing of bottles from the carrier one at a time. The release mechanism also includes two spaced apart slits extending from each of the bottom panel apertures to facilitate removal of bottles from the carrier. The bottom panel slits are sufficiently long to overcome the friction grip of the carrier on the bottle, and is preferably less then ½".

46 Claims, 10 Drawing Sheets

U.S. PATENT DOCUMENTS

| | | |
|---|---|---|
| 4,372,598 | 2/1983 | Quelch . |
| 4,378,878 | 4/1983 | Graser . |
| 4,378,879 | 4/1983 | Killy . |
| 4,401,212 | 8/1983 | Fischer . |
| 4,432,579 | 2/1984 | Denmark et al. . |
| 4,453,630 | 6/1984 | Helms et al. . |
| 4,621,734 | 11/1986 | Heijnen et al. . |
| 4,736,977 | 4/1988 | Killy . |
| 4,850,478 | 7/1989 | Kidd . |
| 4,925,020 | 5/1990 | Gordon . |
| 4,936,455 | 6/1990 | Bienaime . |
| 5,020,661 | 6/1991 | Marco . |
| 5,058,735 | 10/1991 | Bienaime . |
| 5,125,506 | 6/1992 | Galbierz et al. . |
| 5,139,137 | 8/1992 | Marco . |
| 5,186,321 | 2/1993 | Fadus . |
| 5,323,895 | 6/1994 | Sutherland et al. . |
| 5,328,024 | 7/1994 | Sutherland . |
| 5,351,815 | 10/1994 | Fogle et al. . |
| 5,445,262 | 8/1995 | Sutherland . |
| 5,476,170 | 12/1995 | Weber . |
| 5,485,914 | 1/1996 | Martin . |
| 5,487,463 | 1/1996 | Harris . |
| 5,487,464 | 1/1996 | Galbierz et al. . |
| 5,590,776 | 1/1997 | Galbierz et al. . |

MULTI-PACK CARRIER FOR BOTTLES

CROSS-REFERENCE TO RELATED APPLICATIONS

The invention shown and described herein is an improvement of the box top bottle carrier shown and described in our U.S. Pat. No. 5,590,776, which is incorporated herein by reference.

STATEMENT REGARDING FEDERALLY SPONSORED RESEARCH OR DEVELOPMENT

Not Applicable.

BACKGROUND OF THE INVENTION

This invention relates to multi-pack carriers for bottles, and in particular a multi-pack carrier which is simple to manufacture and easy to assemble, which will securely hold bottles therein, and which will allow for easy release of the bottles from the carrier.

Multi-pack carriers have long been available to facilitate the carrying of bottles or the like so that customers can buy bottles of beverages in 6-packs or the like. Many of these carriers, however, lack total consideration of the economics of high speed manufacture, bulk shipment in a flat state, ease and speed of assembly of the carrier, as well as ease of container release and removal by the consumer. Other available carriers, while suitable for their intended purpose, are complicated in construction, in their assembly, and do not facilitate removal of bottles from the carrier by the consumer.

The most common multi-pack carrier for bottles is the basket carrier, which, as the name denotes, is formed into a basket which receives the bottles. Six-packs of soda or beer are often seen in such basket carriers. Basket carriers, as is known, form a plurality of individual compartments which separate the bottles from each other. Basket carriers are formed from complex blanks which produce a significant amount of waste. Because the blanks for basket carriers are complex, they require complex machinery to assemble the baskets. Typically, the basket carriers are formed and placed into a shipping case and filled with empty bottles. The bottles in the basket are then transported to the filling plant. At the filling plant, the bottles are removed from the basket carrier, washed, and then placed on the filling line. Once the bottles are filled and capped, crowned, or otherwise closed, they are placed back in the carrier. Basket carriers also create difficulties in the store. They are difficult to stack, and when they are, a basket can catch the crown of a bottle in a basket adjacent the selected basket. This can cause the bottles in the adjacent basket to fall, resulting in breakage and loss of product, as well as associated revenue for the store.

To overcome the problems associated with basket carriers, many different carriers have been provided which are in the form of flat or planar carriers which accept the bottles or in the form of sleeves through which the bottles extend. These carriers typically have openings through which the neck of the bottle extends. The apertures are surrounded by tabs which in many instances catch the bottom of the bottle crown to hold the bottle in the carrier. Other carriers provide tabs which catch the bottom of the bottle's chime or take-out bead. To remove the bottles from the carriers, the bottles must be pulled downwardly through the tabs. As can be appreciated, in the first instance, the crown, which is crimped when secured to the bottle, will catch the tabs making the bottle difficult to remove. In the second instance, the chime will have to be pulled through the upwardly extending tabs. In either case, the upward force exerted by the tabs against the cap or chime of the bottle must be overcome to remove the bottle from the carrier. If the carrier is to be strong enough to carry a group of bottles, this force can be difficult to overcome.

Presently available carriers are scored or embossed to provide a hinge point for the tabs. When the carrier is scored or embossed to form the tabs, the fibers, which provide strength to the carrier, are broken, leading to a loss of strength of the carrier. Further, the scoring of the paperboard enables the paperboard carrier to more easily absorb moisture. As can be appreciated, the absorption of moisture will weaken the carrier.

To overcome the difficulty of removing the bottles from the carriers, carriers have been provided with release mechanisms. Examples of carriers which provide release mechanisms for the bottles are shown in U.S. Pat. No. 3,926,306 to Klygis and U.S. Pat. No. 4,401,212 to Fischer. The Klygis carrier is in the form of a sleeve and is provided with a pull-tab which extends along a side panel of the carrier. The pull tab enlarges the aperture so that the bottles can be removed therefrom. However, because a single pull tab is provided and because the pull tab enlarges the apertures through which the bottle necks extend, removal of the tab can weaken the carrier and allow the bottles to accidentally escape from the carrier.

The Fischer carrier includes a key-slot style aperture through which the bottle neck extends. To remove the bottle from the carrier, the bottle is moved relative to the key slot to be aligned with a larger diameter area of the key slot. This larger diameter area has a diameter larger than the chime or take-out bead of the bottle and the bottle may be removed from the carrier. However, the bottle may accidentally come into alignment with the larger diameter area and become loose in the carrier.

Another release mechanism is shown in our U.S. Pat. No. 5,487,464 which is incorporated herein by reference. The release mechanism shown therein provides independent pull tabs for each bottle in a flat or planar carrier. All these above noted carriers work well for plastic (PET) bottles. However, because they do not limit pendulous motion of the bottles relative to the carrier and each other, they are not typically used with glass bottles.

Glass bottles are relatively long and have narrow diameters when compared to beverage cans. Thus, when the bottle is held by its neck, the bottle may form a pendulum with respect to the carrier and be able to swing when held by the carrier. If the bottles are allowed to swing too much, they can contact each other and break. Regulatory and practical requirements dictate against a construction which will allow the bottle to swing in the carrier. In our U.S. Pat. No. 5,590,776, which is incorporated herein by reference, we disclosed a box top carrier which will substantially prevent bottles, when placed in the carrier, from swinging relative to the carrier and to each other. The carrier is also provided with a release mechanism which overcomes the problems noted above. Although the release mechanism disclosed in that application works extremely well, and the carrier holds the bottles securely to reduce breakage, the carrier can be improved upon. The carrier, for example, can be provided with a release mechanism which allows for easier withdrawal of bottles from the carrier. It can also be modified to allow bottles, when packaged in the carrier, to be inserted into a case.

BRIEF SUMMARY OF THE INVENTION

One object of the present invention is to provide a multi-pack carrier which will securely carry a plurality of bottles.

Another object is to provide the carrier with a release so that the bottles can be easily removed from the carrier.

Another object is to provide such a carrier release which will not weaken the carrier or allow remaining bottles to become loose in the carrier.

Another object is to provide such a carrier which will minimize or substantially prevent the bottles from impacting each other when they are carried in the carrier.

Another object is to provide such a carrier which will enable the bottles, when placed in the carrier, to be placed in a case wherein the case includes dividers to separate the bottles from each other.

Another object is to provide such a carrier which maximizes the planar strength of the carrier.

Another object is to provide such a carrier which may be produced at high speed and shipped in bulk in a flat state and which is easy to erect and apply to a group of bottles, either manually or by machine.

Another object is to provide such a carrier which may be reused to facilitate recycling of bottles.

Another object is to provide such a carrier which is recyclable or made from a variety of materials, including recycled materials.

These and other objects will become apparent to those skilled in the art in light of the following disclosure and accompanying drawings.

Briefly stated, a box-top carrier is provided which will support a plurality of bottles as a package when the package (comprising the bottles in the carrier) is lifted or otherwise transported. As is common, the bottles each include a bottle body, a neck extending upwardly from the bottle body, a mouth at a top of the neck, and a take-out bead on the neck below the mouth. The bottle take-out bead has a lower surface defining a chime at a point where the take-out bead lower surface intersects the neck. The carrier is generally quadrilateral in vertical cross-section and includes a top panel, a bottom panel spaced from the top panel, and two side panels extending between the top and bottom panels. The top, bottom and side panels are operatively connected to define a sleeve. The top panel has apertures through which the bottle necks extend and a plurality of slits extending from an edge of the apertures to define a plurality of tabs around the apertures. The bottom panel has continuous and uninterrupted edges extending between the side panels and a plurality of apertures which are generally concentric with the top panel apertures. The top and bottom panel apertures are formed in an array having at least two columns of at least two spaced apart rows, each row having outer apertures spaced from edges of the carrier.

The carrier's top panel is made of at least a top ply and a second ply. The top ply has a plurality of surrounding apertures through which the bottle necks extend and the second ply has a plurality of container receiving apertures formed concentrically with and having a diameter smaller than the surrounding apertures of the top ply. The apertures of the top and second ply comprise the top panel apertures. The tab forming slits extend from an edge of the container receiving apertures to define the tabs of the top panel.

The carrier includes a release mechanism to facilitate removal of the bottles from the carrier. The release mechanism includes a first pair of tear lines in the top panel extending from a first edge of the top panel to a first of the slits of one row of the outer container receiving apertures and a second pair of tear lines in the top panel extending from a second edge of the top panel opposite the first edge to a first of the slits of the other outer row of top panel container receiving apertures. The pairs of tear lines include two spaced apart tear lines which define tear strips extending between the top panel apertures, such that when a tear strip is pulled, the strip forms a space between the columns of apertures in the top panel and a gap in the top panel apertures which place the top panel apertures in communication with the space.

If the carrier is a six-pack the array of apertures in the top and bottom panels includes an inner row of apertures positioned between the outer rows of apertures. In this instance, the release mechanism includes a third pair of tear lines in the top panel extending from a second row of surrounding apertures to the first row of surrounding apertures. To facilitate the amount or distance that the tear strip or release tab is pulled, fold lines are provided on the tear strips. A fold line extends between second slits of at least one of the outer apertures. A fold line is also provided between second slits of the inner apertures.

To prevent the formation of lines of weakness from the tear lines in the top and second ply, the tear lines in the top and second ply correspond to each other but are at least partially offset from each other. That is, the tear lines in the top and second plies of the top panel are not fully aligned with each other. Preferably, the tear lines which extend from the edge of the carrier to the outer apertures of the carrier top panel are angled relative to each other in one of the plies of the top panel to form a generally trapezoidal shaped pull tab in one of the plies. Preferably, the trapezoidal pull tab is formed in the second ply of the top panel. It has a first end at the edge of the carrier which is narrower than the second end which is adjacent the container receiving apertures in the top panel. The pull tab in the top ply has parallel edges.

In one embodiment, the third pair of tear lines in the first and second ply overlie each other. In an alternative embodiment, the portion of the pull tab (defined by the third pair of tear lines in the top and second plies) that extends between outer apertures and the inner apertures of the top panel also has edges that are offset from each other between the top and second plies. In this embodiment, the pull tab in one of the top and second plies have edges which define a triangle which extends away from the center of the carrier and meet at an apex. Preferably, in this embodiment, the pull tab in the second ply has parallel edges and the pull tab in the top ply has the generally triangular shaped edges. Lastly, the pull tabs are symmetrical about a center line of the pull tabs.

In a second embodiment of the release mechanism, the carrier is provided with a finger hole which allows for carrying of the carrier. The tear strips are defined by tear lines which extend from the finger hole to the apertures adjacent the finger hole. The tear lines are preferably diagonal tear lines, and where there are four apertures in the top panel adjacent the finger hole, the tear lines form an "X" through the finger hole. The tear strips are pulled along the axial direction of the carrier. The carrier may also include fold lines in the top panel which extend generally perpendicular to the direction of pull of the tear strip (i.e., are generally perpendicular to the side panels of the carrier. This release mechanism allows for two apertures to be opened simultaneously.

A third embodiment of the release mechanism includes individual tear strips for each aperture in the top panel such that each aperture can be opened individually to allow for selected bottles to be removed from the carrier one-at-a-time. The carrier top panel includes a first row of apertures, a second row of apertures, a third row of apertures between the first and second rows of apertures, and finger holes between each row of apertures. The release mechanism includes a first pair of tear strips and a second pair of tear strips for the first and second rows of apertures and a third pair of tear strips for the third row of apertures. The tear strips of the first and second pair of tear strips are each defined by a first tear line extending diagonally from the finger hole toward an end of the carrier to at least tangentially intersect an aperture of the carrier and a second tear line which extends from the finger hole toward a side of the carrier. The second tear line is sufficiently long, such that when a selected tear strip is pulled, an opening is formed between a selected aperture and the finger hole which is sufficiently wide for the neck of a bottle to pass through. A fold line extends generally from the second tear line to the respective aperture for each aperture in the first and second rows of apertures. The fold line is substantially perpendicular to the second tear line.

Each tear strip of the third pair of tear strips is defined by the second tear line and a third tear line extending from the aperture of the third row to the second tear line. The third tear line is generally parallel to a side edge of the carrier. A fold line is also provided for each of tear strip of the third pair of tear strips. The fold line extends diagonally between the finger hole and the apertures.

The tear strips of the second and third embodiments of the release mechanism avoid the use of tear lines which are generally parallel to the axis of the carrier. Thus, the tear lines in the top and second plies of the top panel which make up the tear strips can directly overlie each other without significantly impairing the strength of the carrier top panel.

To further facilitate removal of the bottles from the carrier, the release mechanism can also be provided with at least one slit (and preferably two spaced apart slits) extending from each of the bottom panel apertures. The slits preferably extend inwardly (i.e., toward the center of the carrier bottom panel), but can extend in any desired direction for the bottom panel apertures. The slit forms a lip which bends downwardly when a bottle is pivoted out of the carrier. The bending of the lip breaks the hold of the carrier on the bottle to facilitate withdrawal of bottles from the carrier. The slit is sufficiently long to overcome the friction grip of the carrier on the bottle, and is preferably less then ½".

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes adaptations, variations, alternatives and uses of the invention, including what we presently believe to be the best mode of carrying out the invention.

Figure 1:
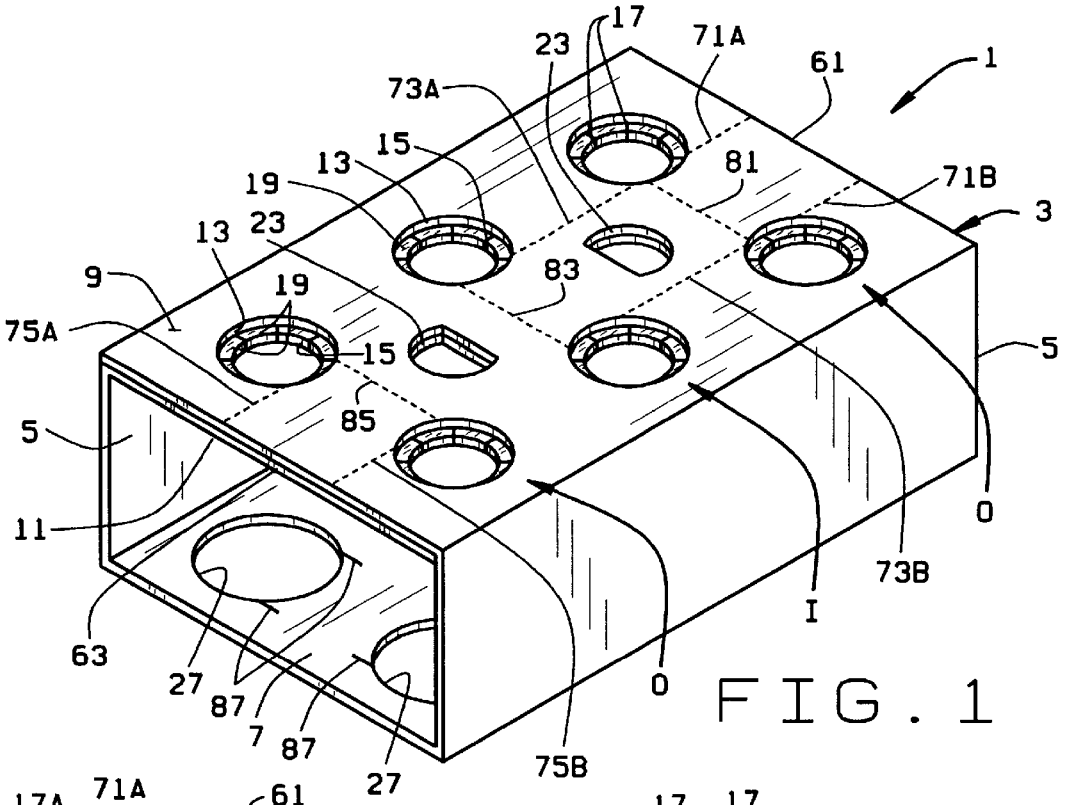
FIG. 1 is a perspective view of a box-top carrier of the present invention.
Figure 2:
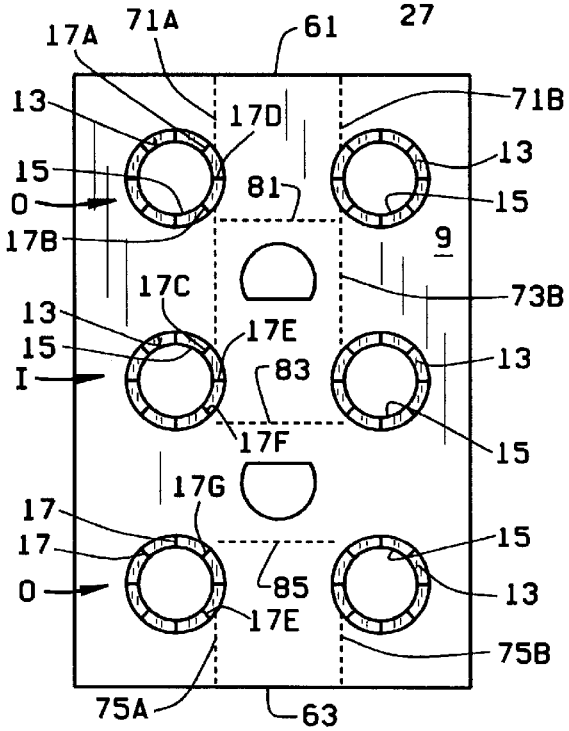
FIG. 2 is a top plan view of the box top carrier.
Figure 3:
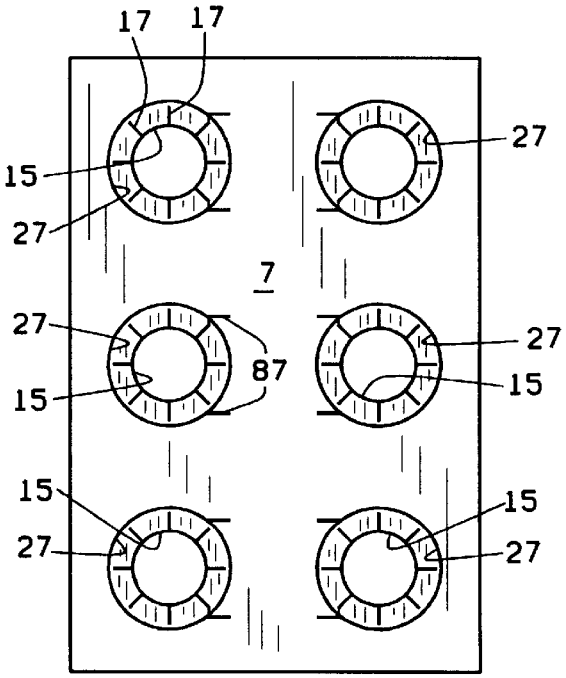
FIG. 3 is a bottom plan view of the box top carrier, looking upwardly.

A box-top carrier 1 of the present invention is shown in FIGS. 1–3. The carrier 1 may be made of any desired material, but is preferably made of paperboard so that the carrier may be recycled after use. The carrier may be made from virgin or recycled paperboard, or a combination of virgin and recycled paperboard. Preferably, the paperboard is solid unbleached sulfate virgin Kraft board, rather than corrugated cardboard, such as is used in Kidd, U.S. Pat. No. 4,850,478. As the need arises, a higher paperboard strength, stiffness, and rigidity can be obtained by increasing the paperboard density, by varying the paperboard formulation, by varying the machining or plying techniques used in producing the paperboard, by using paperboard made according to the Fordranier or other processes, or by using a paperboard in which the plies of the paperboard are laminated together, such that the machine direction of the plies are offset from each other by, for example, 90°. Further, the paperboard can be made from plies of different strengths. The paperboard for the carrier can also be formulated to provide a high wet strength. Brown, as-produced, paperboard can be used for the carrier. However, the paperboard is commonly made white, either by bleaching or coating the Kraft paperboard, to enable the use of quality graphics and to produce an aesthetically pleasing carrier. Other techniques can also be used to whiten brown, as-produced, paperboard. The carrier, as noted above, can also be made from plastic or other materials without departing from the inventive concept.

Figure 5:
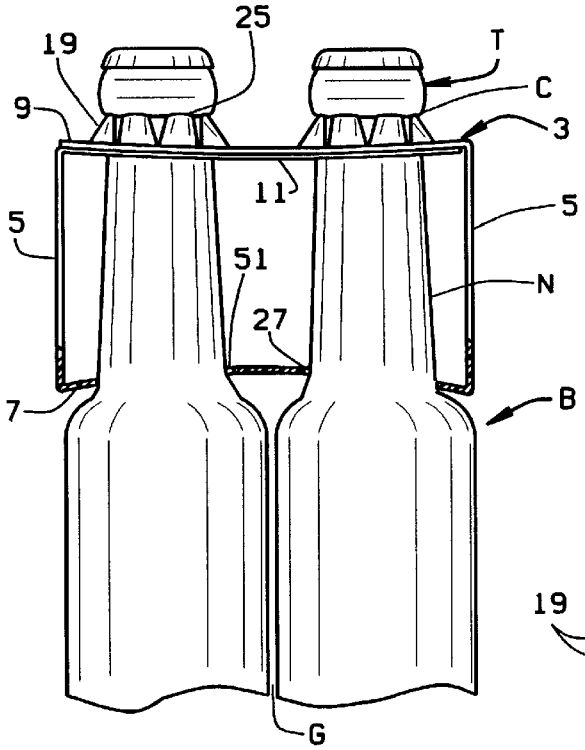
FIG. 5 is a side elevational view, partly in cross-section, of the carrier with bottles placed therein.
Figure 6:
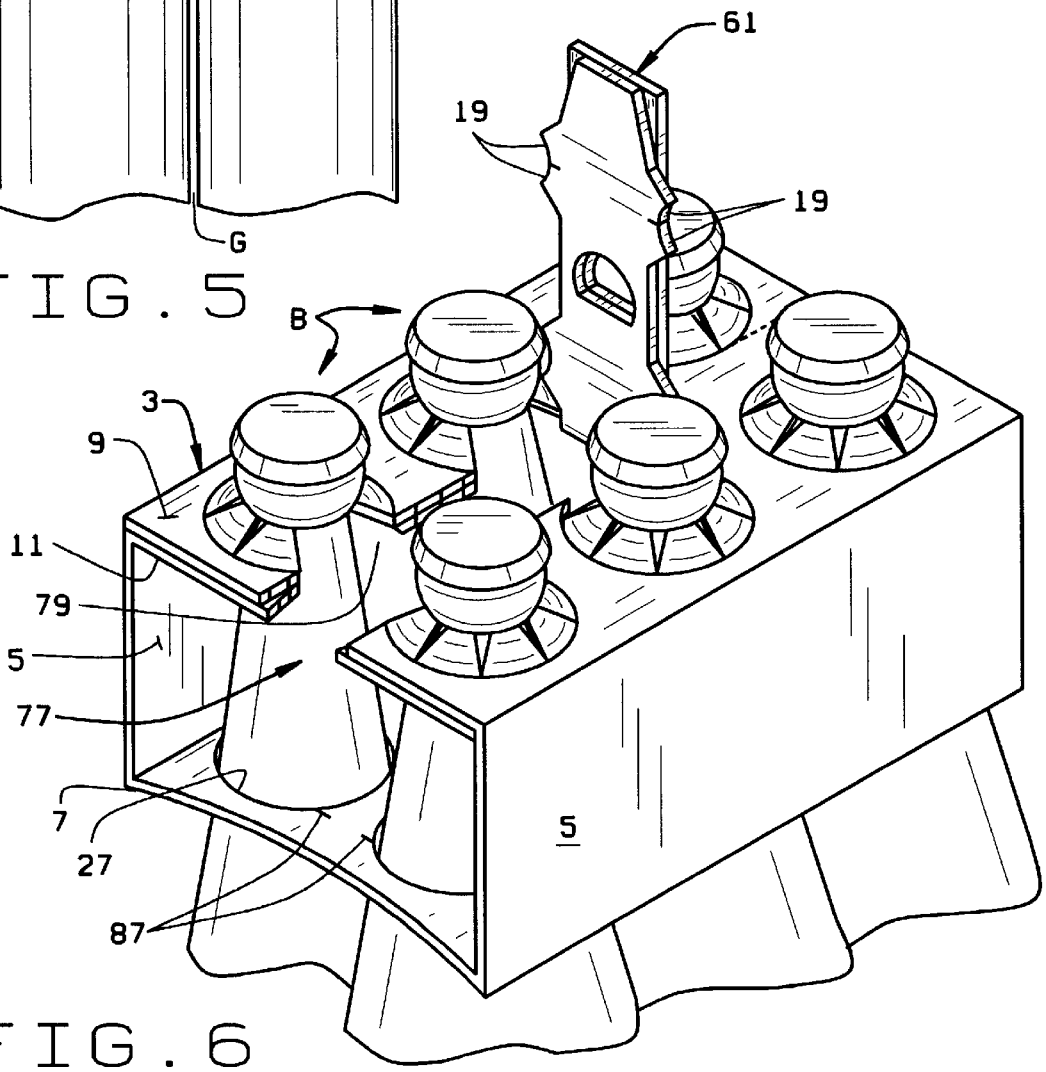
FIG. 6 is a perspective view of the carriers with bottles therein and a release mechanism of the carrier being opened to release a selected bottle from the carrier.

Conventional bottles B are shown in FIGS. 5 and 6 in the carrier 1 of the present invention. The bottles B each have a body, a neck N extending up from the body, a take-out bead T at the top of the neck N and below the mouth of the bottle, and a closure which closes the mouth. The take-out bead T forms a chime C with the neck of the bottle where the bottom of the take-out bead intersects the neck. Although the invention is described in relation to bottles, such as glass bottles, it will be understood that the invention is equally applicable to plastic bottles and bottles made of other materials.

The carrier 1 (FIGS. 1–3) includes a top panel 3, side panels 5, and a bottom panel 7 which are interconnected to form an open-ended sleeve. Front and/or back panels may be added to close one or both ends of the carrier. The top panel 3 is made of two plies and has a top ply 9 and a bottom or reinforcing ply 11. The two plies are used to provide for positive retention of the bottles, as will be described below, as well as to provide increased planar strength and rigidity for shipping and handling of packages of containers. Although two plies are preferred for the top panel, if the top panel is made strong enough, the top panel can be made of a single ply. Alternately, the top panel can be made of three or more plies, if desired.

The top ply 9 of the carrier has a plurality of surrounding apertures 13 which are evenly spaced about the top ply. Typically four or six apertures are formed in the top panel in a 2×2 or 2×3 array. The apertures are shown in a 2×3 array, of two columns and three rows. The array of apertures includes two outer rows O spaced inwardly from the front and back edges of the carrier, and an inner row I of apertures positioned equidistantly between the two outer rows O of apertures. Other aperture configurations with any desired number of apertures could of course be used.

The reinforcing ply 11 has a plurality of container receiving apertures 15 which have a diameter slightly smaller than the diameter of the bottle's neck N at a point below the bottle's take-out bead T. A plurality of slits 17 radiate outwardly from the container receiving apertures 15 to define fingers or tabs 19. (FIG. 5) The container receiving apertures 15 are positioned to be concentric with the surrounding apertures 13 in the top ply 7. The surrounding apertures 13 have a diameter sized to be substantially equal to, or slightly less than, the diameter of a circle defined by the radially outermost end of the slits 17. The edge of the surrounding aperture 13 thus defines a folding point for the tabs 19. The scoring or embossing typically used to define the fold line for the tab therefore is not necessary. The elimination of this fold line in our carrier maintains the structural integrity of the carrier in its tabs and reduces the carrier's susceptibility or vulnerability to weakening by the absorption of moisture. The carrier 1 is also provided with finger holes 23 which pass through both plies of the top panel 3 so that a consumer can easily pick up and carry the multi-pack carrier 1. As is common, finger holes 23 are preferably D-shaped.

When the bottles are placed in the carrier, the tabs 19 engage the chime C of the bottle, as seen in FIG. 5. The tabs 19 are of a length, such that they form an angle, preferably, of about 60° with the top ply 9 when the bottle is in the carrier and the tip 25 of the tab is engaged with the bottle's chime C. If the angle is much greater than 60° (i.e., more than about 75°), the tabs 19 will be too vertical and will lessen the ability of the tab 19 to engage the chime C. If the angle is much less than 60° (i.e., less than about 45°), the tabs 19 will be too horizontal and will tend to collapse, not having enough vertical strength to hold the bottles B in the carrier. At present, the use of virgin Kraft paperboard for the carrier yields greater strength and rigidity for the tabs 19 without the need to consider cross- or machine-direction weaknesses.

The tabs 19, as can be seen, are formed from the container receiving apertures, and thus have an inner edge which defines an arc of the circle of the container receiving aperture. Due to the arc of the tab edge, the tab 19 will not contact the bottle chime along 100% of the edge. Rather, the contact of the tab against the chime will be at a pair of points. Despite this, the use of circular container receiving apertures are preferred. However, the container receiving apertures, and hence the tabs 19, can be formed so as to obtain 100% contact of the tab with the bottle chime.

The number of slits 17 formed around the container receiving apertures 15 depends on the diameter of the container receiving apertures 15 to prevent the tabs from being too narrow or too broad. If the tabs are too broad, there will be insufficient contact of the tip or radially innermost edge 25 of the tab 19 with the bottle chime C and the bottle will not be adequately supported by the tabs 19 in the carrier. When a round hole is used, we have found that a tab with a side-to-side width of about 0.25" to 0.35" at the tip 25 of the tab (i.e. at the radially innermost edge of the tab) works well. To maintain this dimension, we have found that it is preferable to provide eight tabs when the container receiving aperture 15 has a diameter of 0.625" to 0.875"; for diameters between 0.875" and 1.375", there are preferably twelve (12) tabs; and; for diameters between 1.375" and 1.875", there are preferably sixteen (16) tabs. As the diameter of the container receiving apertures 15 become greater than 1.875", the number of tabs 19 will have to be properly increased. As noted above, the tabs are sufficiently long to form an angle of about 45° to about 75° with the carrier top, and preferably about 60° with the carrier top 5 when the tab engages the chime C of the bottle. This preferred tab size (i.e., length and width) provides for a tab which will clear the diameter of the take-out bead T when the bottle is passed through the aperture, yet will allow the tab to be resilient, such that the tab will spring back to engage the chime C of the take-out bead T of the bottle B.

The tabs 19 engage the chime C rather than the cap or crown of the bottle B. When the crown of a glass bottle is engaged by the tab, the seal formed by the crown with the bottle can be impaired. The integrity of this seal or closure is not affected when the tab engages the chime. Although it is preferred that the tabs engage the chime C of the bottle, when PET bottles with screw on caps are being placed in the carrier, the tabs may engage the bottom of the bottle cap. Because the caps are screw on caps, the engagement of the tab with the cap will not impair the seal.

The bottom panel 7 has apertures 27 (FIGS. 1 and 3) so that the box top carrier 1 can be applied over a bottle. The apertures 27 are positioned substantially concentrically with the apertures 13 and 15 and have a diameter equal to or slightly smaller than the diameter of the bottle's neck point of contact of the aperture 27 with the neck N. The apertures 27 are shown to be circular, but could be other shapes as well. For example, the apertures 27 could be oval or oblong.

The carrier blank 31 (FIG. 4) from which carrier 1 which is made is preferably a one-piece blank made from a single piece of material. As discussed in our U.S. Pat. No. 5,590,776, the carrier 1 can also be made from two blanks, wherein the second ply of the top panel is formed from a second blank. The blank 31 has two end sections 33 and 35 which form the top and second plies 9 and 11 (FIG. 6), respectively, of the top panel 3 are made. Blank sections 37 and 39 are hingedly connected to sections 33 and 35, respectively, and form side panels 5 of the carrier 1. The sections 37 and 39 are separated from the sections 33 and 35 by fold lines 41 and 43. A center section 45 is hingedly connected to the sections 37 and 39 along fold lines 47 and 49 to define the bottom panel 7 of the carrier 1.

The carrier blank 31 is preferably die-cut in a single step. As can be seen, the blank is linear or quadrilateral. The blanks therefore can be formed with a minimum amount of waste. The blanks 31 are folded into carriers 1 using standard folding equipment. In the folding or forming process, the two end sections 33 and 35 are glued, bonded, or otherwise connected together to ensure that the blank is folded into, and remains, a sleeve. Other methods could be used to secure the two sections 33 and 35, e.g. they could be stapled or tab locked together.

The carrier 1, when formed, can be flattened so that the blank can be shipped easily in bulk. At a packaging plant, the flattened carriers are easily erected to their rectangular form, and can be easily applied to a group of bottles to form a package.

To apply the carrier 1 to a group of bottles B, the bottles are initially grouped into an array of the appropriate number of bottles, i.e., a 2×2 array for a four-pack, a 2×3 array for a six-pack, etc. The carrier is then taken from its flattened state and squared or opened, to its state shown in FIG. 1. The carrier is then simply applied over the tops of the bottles, so that the bottle caps will be forced through the container receiving apertures 15 to urge the tabs 19 upwardly until the bottle's take-out bead T rests or sits on the ends 25 of the tabs, as seen in FIG. 5. As described above, the edge of the surrounding aperture 13 will form the fold line of the tabs 19. The tabs 19 will thus all fold or bend at the desired point, so that they will all be of the desired size. Because there is no fold line in the lower ply 11 to define the ends of the tabs 19, the surrounding apertures 13 maintain the tab stability at the tab base and help prevent elongation of the slits 17 in the lower ply 11 as carrier B is applied over the bottles.

As seen best in FIG. 5, the bottom panel apertures 27 are slightly smaller than the bottle's neck N, at the point of the neck N where the bottom panel apertures 27 surround the bottle neck N. The side panels 5 are of a length, such that when the carrier is applied to the bottles, the top panel 3 will become downwardly arched and the bottom panel 7 will become upwardly arched, as shown in FIG. 5. This brings the outer edges of the aperture 27 (i.e. the edges of the aperture closer to the carrier sides 5) in the bottom panel 7 into tighter contact with the outer surfaces of the bottle neck N. Stated differently, when the carrier 1 is applied over the bottles B, the outer edge of the bottom panel apertures 27 will contact the bottle edge, and frictionally grip the edge of the bottle. This will cause the bottom panel to arch upwardly, as shown in FIG. 5, and the bottles will be brought toward each other. The majority of the gripping forces on the bottle neck are thus borne by the outer edges of the apertures 27 (i.e., the edges of the apertures closest to the side panels 5), and some frictional contact will occur between the inner edge of the aperture 27 and the bottle neck N. In some instances, it can be desirable to have the bottom panel apertures 27 offset slightly from the top panel apertures 13 and 15. This slight offset can increase the friction grip of the carrier 1 on the bottles.

When the bottles are packaged in the carrier 1, and the package is in a relaxed state, i.e. sitting on a surface, there may be a small space or gap G between adjacent bottles, as is shown in FIG. 5. As is known, shipping cases in which bottle packages (such as six-packs) are placed have dividers between the bottles to prevent the bottles from contacting each other. These dividers are generally very thin. Thus, when the package of bottles, packaged into carrier 1, is inserted in a case, the dividers will simply slide in the gap G between the bottles. The bottles will not have to be separated or spread from each other to be placed in the case. This will greatly facilitate placement of the packages of bottles in shipping cases.

When the multi-pack carrier 1, with bottles B therein, is lifted, the outer edge of the apertures 27 will contact the bottles more forcibly and intensify a friction grip against the bottles to prevent the bottles from pivoting in the carrier. When the carrier 1 is lifted, the top panel 3 flattens or becomes more planar and pushes the side panels further downwardly, relative to the bottles, causing the bottom panel 7 to arch upwardly even more. This makes the binding effect of the carrier against the bottle even greater. This will help prevent impacts between the bottles. Because the arched aspect of the bottom panel facilitates preventing the swinging of bottles, the bottom panel preferably is made from a single section, and thus has a continuous, uninterrupted side edge extending between the two side panels 5. The bottom panel apertures 27, and hence the top panel apertures 13 and 15, are positioned on the carrier such that the bodies of the bottles will contact the bodies of neighboring bottles, when the carrier is lifted. Because the bottles are in contact with each other, when the carrier is lifted, the bottles will not be able to swing relative to each other. This, in combination with the binding effect of the carrier on the bottle, will further aid in preventing impacts between the bottles.

As shown in FIG. 5, the bottles need not be in contact with each other. Even in this configuration, where the bottles do not contact each other, the binding effect of the carrier on the bottles will remain the same, and that the carrier 1 will substantially prevent impacts between the bottles when the package is carried. The mechanics of the carrier will cause the two rows of bottles (in a four or six pack, for example) to pivot such that the bottle bodies more toward each other slightly. This slight rotation of the of the bottles towards each other will increase the binding effect of the carrier on the bottles without the bottles coming into contact with each other.

As noted, and best seen in FIG. 3, the apertures 13 and 15 in the top panel 5 are concentric with the bottom panel apertures 27. No radial offset between the apertures of the top and bottom panels are needed to create a binding effect of the carrier on the bottle.

Figure 4:
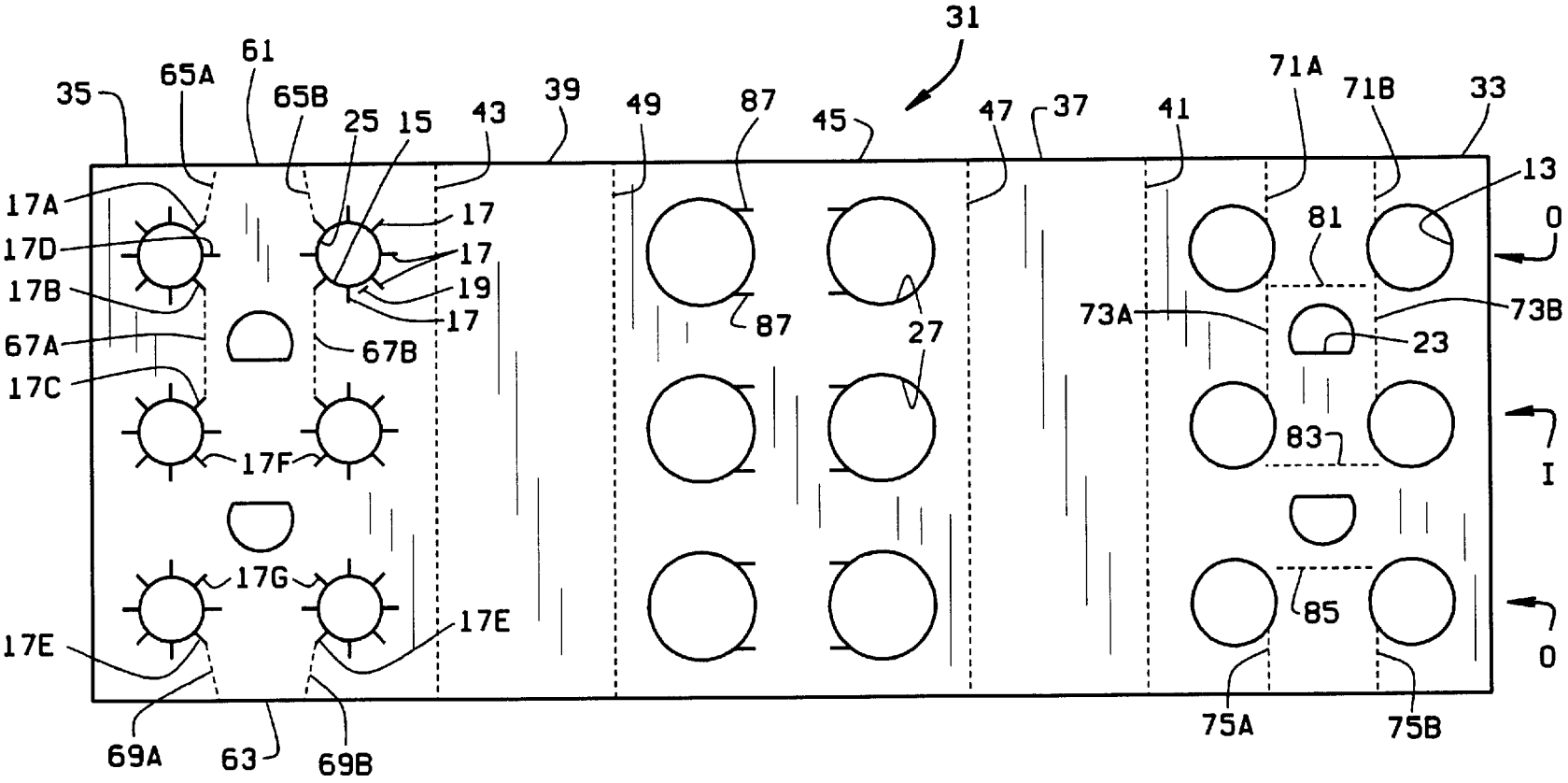
FIG. 4 is a plan view of a blank used to form the carrier.

The carrier (FIG. 1) is provided with two release tabs 61 and 63 which are in the form of tear strips and which extend between the two columns of apertures in the top panel 3. The release tabs or strips are each defined by a series of spaced apart lines of weakness, such as perforations, scores, or tear lines (referred to broadly as tear lines) in each of the two plies of the top panel 3. With reference to FIG. 4, tab 61 is formed by two sets of spaced apart tear lines. The first set of spaced apart tear lines 65A and 65B extend from the edge of the carrier top panel second ply 11 (blank section 35) to the end of one of the slits 17A extending from the outer row O of container receiving apertures. As seen, the tear lines 65A and 65B are not parallel to each other. Rather, they are angled toward each other such that they are closer to each other at the edge of the blank than at the end of the slits 17A.

The second set of spaced apart tear lines 67A and 67B extends from the end of another of the slits 17B of the outer row apertures to the end of a slit 17C of the inner row apertures I of the second ply 11. The tear lines 67A and 67B are preferably parallel to each other. Preferably the slits 17A and 17B are separated by a slit 17D.

The tab 63 is made of one set of spaced apart tear lines 69A and 69B extending from the opposite edge of second ply 11 (blank section 35) to the end of one of the slits 17E of the other outer row apertures. As with the tear lines 65A and 65B, the tear lines 69A and 69B are not parallel to each other, but rather are angled towards each other. Thus, the tear lines 69A and 69B are closer together at the edge of the blank than at the end of the slit 17E.

The top ply 9 (blank section 33) includes three sets of spaced apart tear lines 71A,B, 73A,B, and 75A,B which correspond with the tear lines 65A,B, 67A,B, and 69A,B, respectively in the reinforcing ply 11 (blank section 35). The tear lines 71A,B, 73A,B and 75A,B are all parallel to the side edges of the carrier. The tear lines 73A,B, on the other hand, preferably define a triangle, as seen in FIGS. 1 and 2, which points towards the side of the carrier. That is, the tear lines 73A,B each have a first leg that extends diagonally from an outer container surrounding aperture towards the side of the carrier and a second leg that extends diagonally from an inner container surrounding aperture towards the side of the carrier. The two legs then join at an apex. The two tear lines 73A and 73B are symmetrical to each other, so that the tear strip 61 is symmetrical about its center. Unlike the tear lines 65A,B and 69A,B, the tear lines 71A,B and 75A,B are generally parallel to each other.

The top ply tear lines 71A,B, 73A,B, and 75A,B correspond to the second ply tear lines 65A,B, 67A,B, and 69A,B when the carrier is formed. The top ply tear lines overlie, but are not aligned with, the tear lines of the bottom ply tear lines. The two plies 9 and 11 of the top panel 3 are secured together (i.e. glued, stapled, etc.) so that the two plies of the tabs 61 and 63 are secured together. As can be appreciated, tear lines 71A,B and 75A,B in the top ply 9 overlie, but are somewhat offset from, tear strips 65A,B and 69A,B in the lower ply 11. This will provide for increased strength and rigidity of the carrier and will substantially prevent the creation of a weak line extending through the carrier top panel which would occur if the tear lines in the two plies were aligned with each other. The prevention of a weak line may also be prevented by changing the rule of the cuts which define the tear lines in the two plies. That is, the tear lines in the first ply can be made of cuts of one rule (i.e., the number of cuts per inch), while the tear lines in the second ply can be made from a second rule. Alternatively, the tear lines in the two plies can be made from two different types of cuts.

Figure 7:
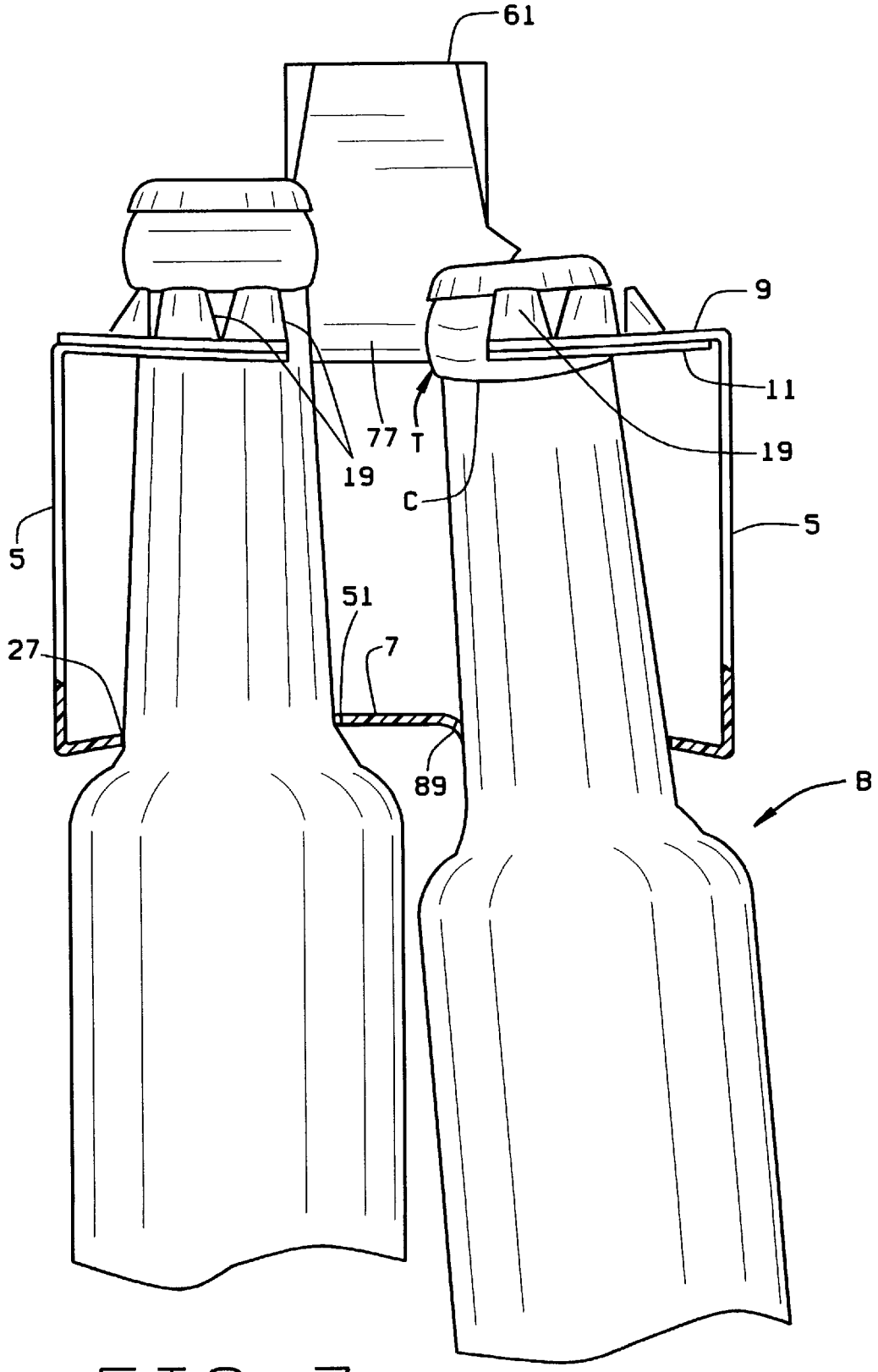
FIG. 7 is a side-elevational view of the carrier, partly in cross-section, showing a bottle being removed from the carrier.

When the tab 61 is pulled, as shown in FIGS. 6 and 7, the two plies are pulled together, and form a space 77 (FIG. 6) between the two columns of bottles and an opening or gap 79 such that the apertures 13 and 15 of the top panel open into the space 77. Preferably, the gap 79 is sufficiently wide that the neck of the bottle can pass therethrough and into the opened space 77 between the two columns of bottles. As can be seen in FIG. 6, the gap 79 is equal to the width of two tabs 19. Depending on the size and number of the tabs 19 in the container receiving apertures, the number of tabs 19 used to form the gap 79 may vary.

The tear strip 61 is preferably provided with two fold lines 81 and 83, formed by embossing, in top ply 9. The first fold line 81 extends between the outer row apertures from the base of slit 17B, as seen in FIG. 2 The second line 83 extends between the inner row apertures from the base of slit 17F. As seen in FIGS. 2 and 4, there is a slit between slits 17C and 17F in the inner row O of apertures. Thus, the gap that will be formed for the inner apertures will be two tabs wide. A fold line 85 is formed at the base of pull tab 63, between the outer row apertures from the base of slits 17G. As seen in FIG. 4, the slit 17G is spaced from the slit 17E by one slit, so that the opening in the aperture when the tab 63 is pulled will be equal in size to two of the tabs 19.

With the aperture diameter shown in the Figures, having the slits which connect with the tear lines spaced as shown creates a gap 79 large enough to accept the neck of the bottle. The fold lines 81, 83, and 85 facilitate hinging of the tab or tear strip at a desired point. The position of the fold lines also facilitates the sizing of the gaps 79*s* provided in the apertures through which the bottle necks are pulled when the release tabs 61 and 63 are pulled. As noted, the gaps 79 are preferably two tabs wide. However, if fewer or more tabs are provided, the gap 79 could be one tab wide or three or more tabs wide. All that is necessary is that the bottle neck be able to be pivoted through the gap 79 into the space 77 fairly easily.

It has been found that even with the space 77 and the gap 79 created by the tear strip when the strip is pulled, the friction grip of the carrier on the bottle which is formed by the interaction of the bottom panel 7 with the bottle neck N can still create some resistance to removal of the bottle from the carrier. Therefore, each bottom panel aperture 27 is provided with two small spaced apart slits 87 which extend inwardly, toward the center of the bottom panel 7. The two slits define a small tab or lip 89. The slits 87, which define lines tangential to the apertures 27, are just long enough so that when the bottle is pivoted in the carrier to remove the bottle therefrom, the force of pivoting will cause the lip 89 to bend down, as shown in FIG. 7. This will break the friction grip of the carrier on the bottle, to make removal of the bottle easier. The slits 27 need not be very long. Preferably, they are less than ½", and may even be as short as ¼" or ⅛", or shorter. Although two slits are shown to create a tab, a single slit formed on the diameter of the bottom panel aperture 27 may work equally as well.

Figure 8:
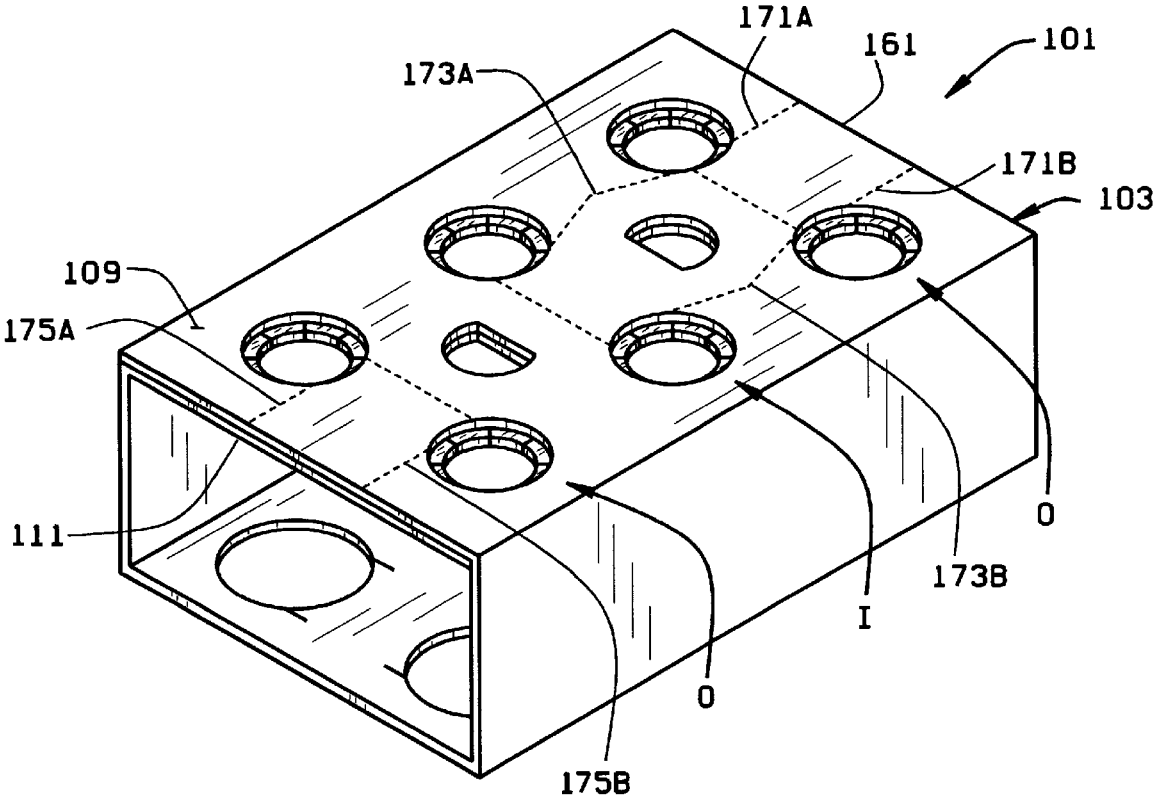
FIG. 8 is a perspective view of the bottle carrier showing a variation of the release tab of FIG. 1.
Figure 9:
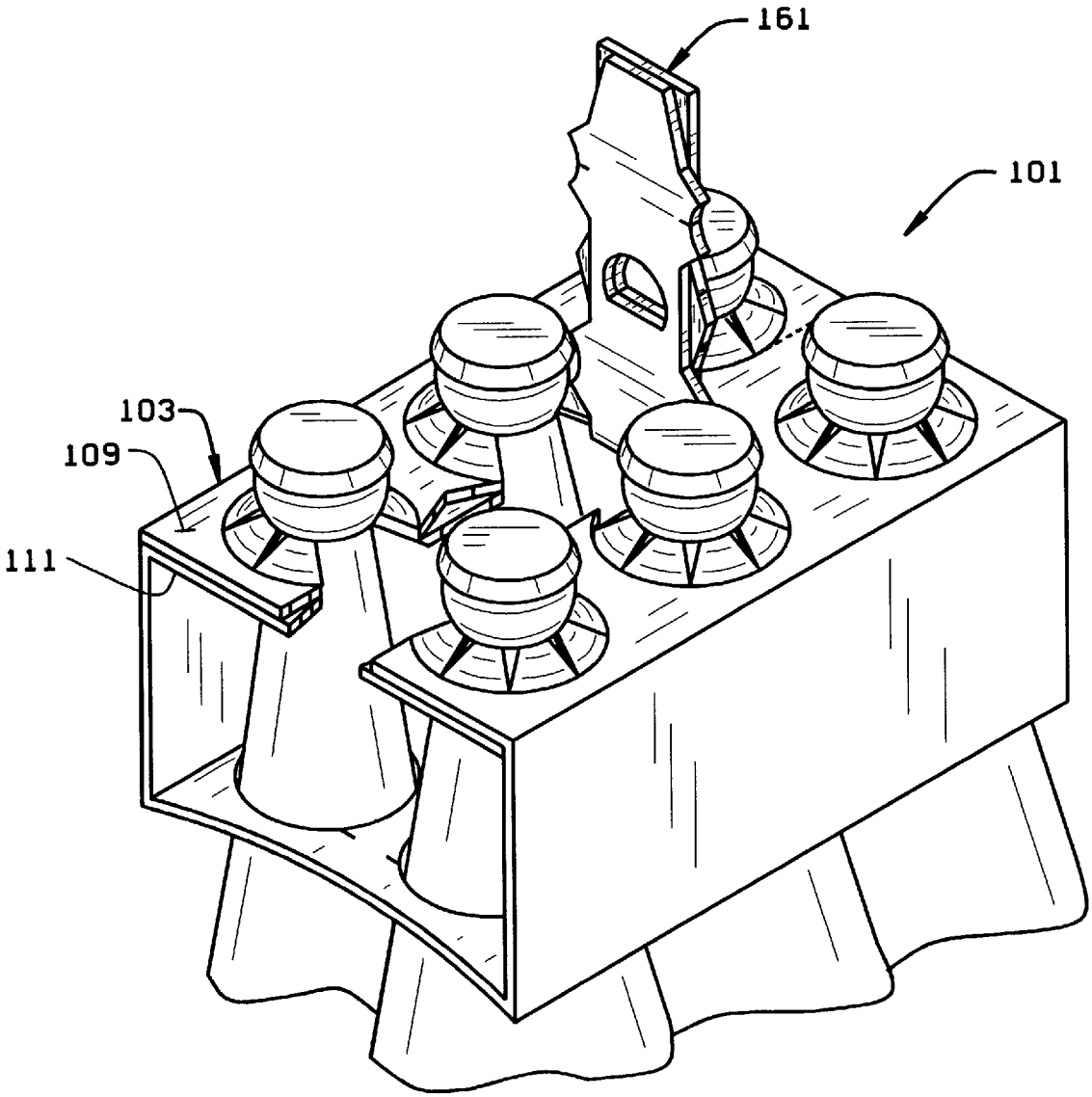
FIG. 9 is a perspective view showing the release tab of FIG. 8 being pulled.

A variation of the tab is shown in FIGS. 8 and 9. The carrier 101 shown in FIGS. 8 and 9 is substantially identical to the carrier 1 of FIGS. 1–7. The only difference lies in the release tab 161. The tear lines in the top panel second ply 111 are identical to the tear lines in the second ply 11, as shown in FIG. 4. Similarly, the tear lines in the top panel top ply 109 are different. Tear lines 171A,B and 175A,B are identical to tear lines 71A,B and 75A,B of FIG. 4. However, the tear lines 173A,B are not parallel to each other as are the tear lines 73A,B. Rather, as seen in FIGS. 8 and 9, they define a triangle which points towards the side of the carrier. That is, the tear lines 173A,B each have a first leg that extends diagonally from an outer container surrounding aperture towards the side of the carrier and a second leg that extends diagonally from an inner container surrounding aperture towards the side of the carrier. The two legs then join at an apex. The two tear lines 173A and 173B are symmetrical to each other, so that the tear strip 161 is symmetrical about its center.

In FIG. 9, the tear strip 161 is shown pulled. The triangle defined by the tear lines 173A,B can be seen. As can be appreciated, by forming the triangular tear lines 173A,B, the tear lines between the inner apertures I and outer apertures O are not parallel to, and do not directly overlie, the corresponding tearlines from the second ply 111. This will prevent the formation of a line of weakness in the carrier top panel 103 between the inner apertures and outer apertures along the tear lines.

Figure 10:
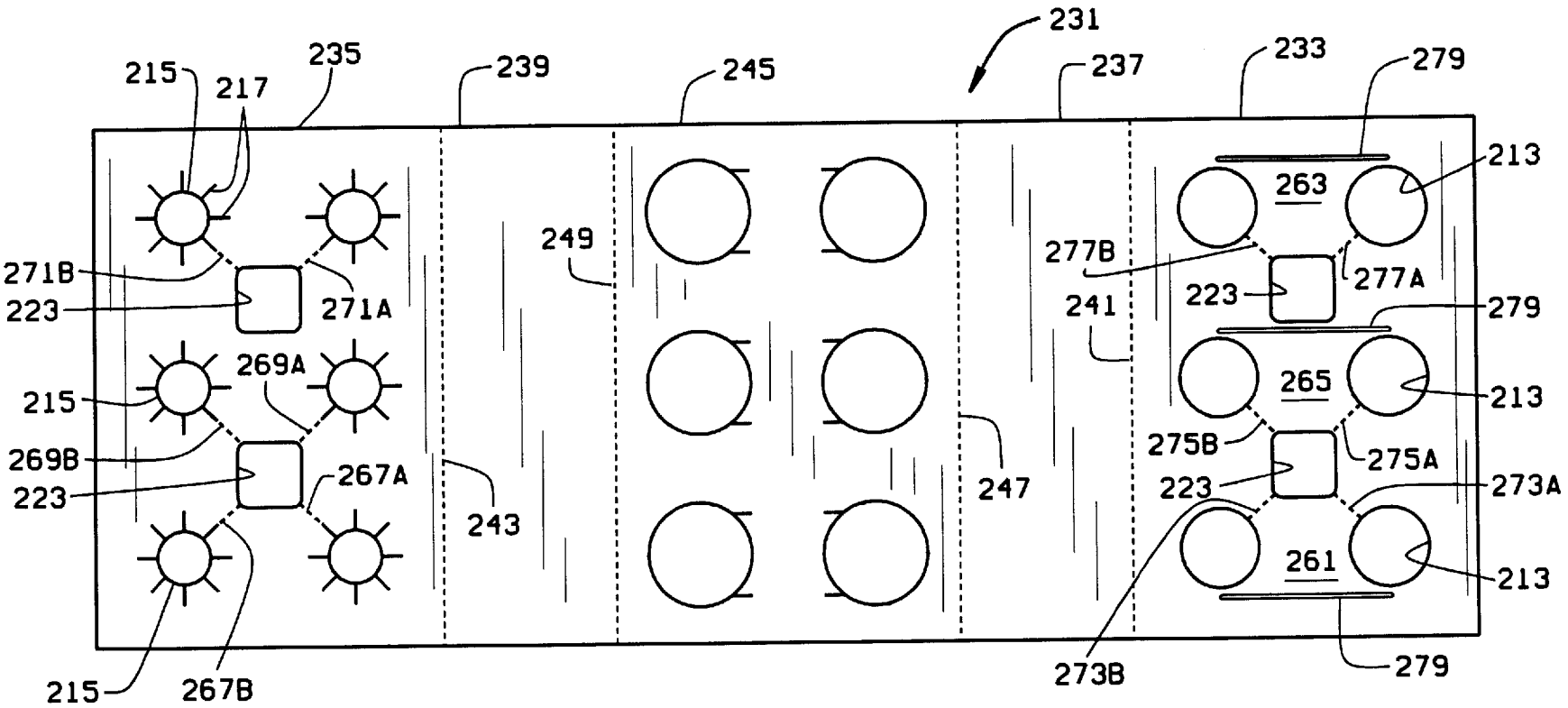
FIG. 10 is a plan view of a blank for forming a carrier having an alternate release tab.
Figure 11:
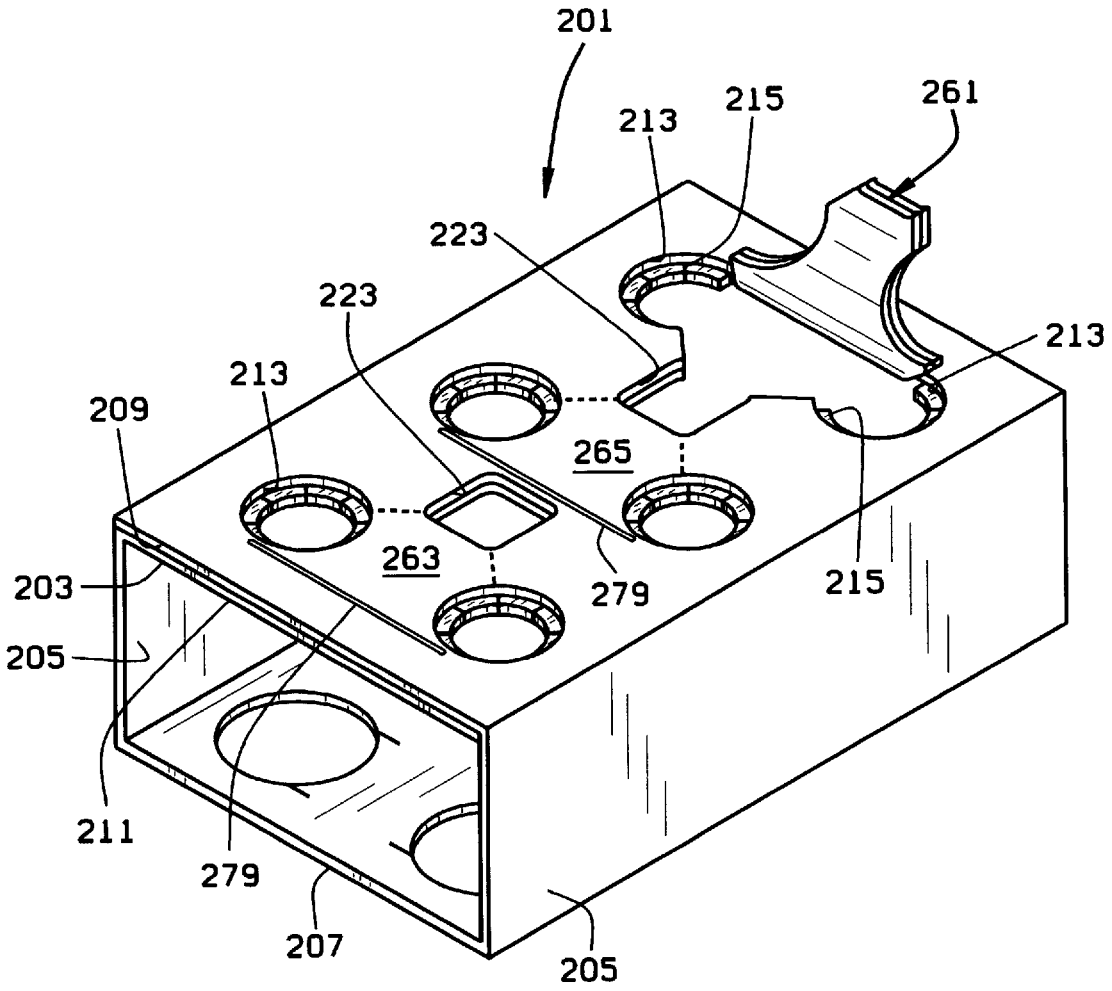
FIG. 11 is a perspective view of a carrier formed from the blank of FIG. 10, with a release tab being pulled.

A carrier 201 with an alternative release tab arrangement is shown in FIG. 11. The blank 231 from which the carrier 201 is made is shown in FIG. 10. Carrier 201 is substantially similar to the carrier 1 of FIG. 1 and includes a top panel 203, side panels 205, and a bottom panel 207. The top panel 203 is made from a top ply 209 and a bottom ply 211. The top ply includes a plurality of container surrounding apertures 213, and the bottom ply includes a plurality of container receiving apertures 215. Tab forming slits 217 extend from the container receiving apertures 215. The apertures 213 and 215, and the slits 217 are substantially identical to the apertures 13 and 15, and the slits 17 of the carrier 1 of FIG. 1, and will not be further described.

The blank 231, like the blank 31 of FIG. 4, includes two end sections 233 and 235 which form the top and second plies 209 and 211, respectively, of the top panel 203 are made. Blank sections 237 and 239 are hingedly connected to sections 233 and 235, respectively, and form side panels 205 of the carrier 201. The sections 237 and 239 are separated from the sections 233 and 235 by fold lines 241 and 243. A center section 245 is hingedly connected to the sections 237 and 239 along fold lines 247 and 249 to define the bottom panel 207 of the carrier 201.

The carrier 201 includes three release tabs 261, 263, and 265. The release tabs 261, 263, and 265 are each defined by tear lines 267A,B, 269A,B and 271A,B which extend from the finger holes 223 to the container receiving apertures 215 in the top panel second ply 211 (the blank section 235 in FIG. 10). The finger holes 223 are shown as squares in FIGS. 10 and 11, and the tear lines extend from the comers of the finger holes to slits 217 which are directed towards the finger holes. Thus, the tear lines 267A,B, 269A,B, and 271A,B are effectively continuations of the slits 217.

The top ply 203 (blank panel 233) has slits 273A,B, 275A,B, and 277A,B which correspond to the tear lines 267A,B, 269A,B, and 271A,B in the second ply 211. Preferably, the top ply tear lines are aligned with the bottom ply tear lines to form a flush edge to the release tab, as seen in FIG. 11. Although the tear lines are aligned with each other, they are not aligned with, or parallel to, the axis of the carrier 203. There is thus less concern for the creation of a line of weakness which will extend through the carrier top panel 203 than there is with the release tabs 61 and 63 of the carrier 1 of FIG. 1.

In FIG. 11, the manner in which the release tab 261 opens the apertures in the top panel 203 is shown. To operate the release tab, the tab is simply pulled from the finger opening 223 toward the apertures desired to be opened. To facilitate bending of the tabs, each tab is provided with a corresponding fold line 279 in the top ply 209. A corresponding fold line is not formed in the second ply 211. When the release tab is pulled, it will open two adjacent apertures, to allow two bottles to be removed from the carrier. Although the fold lines 279 are parallel to the short edge of the carrier 201 and the release tabs are pulled toward one of the short edges of the carrier, the release tabs 261, 263, and 265 could be formed to be pulled toward the long edges of the carrier without departing from the principles of the invention. As can be appreciated, the release tabs 261, 263, and 265 do not extend to any of the edges of the carrier 201.

Figure 12:
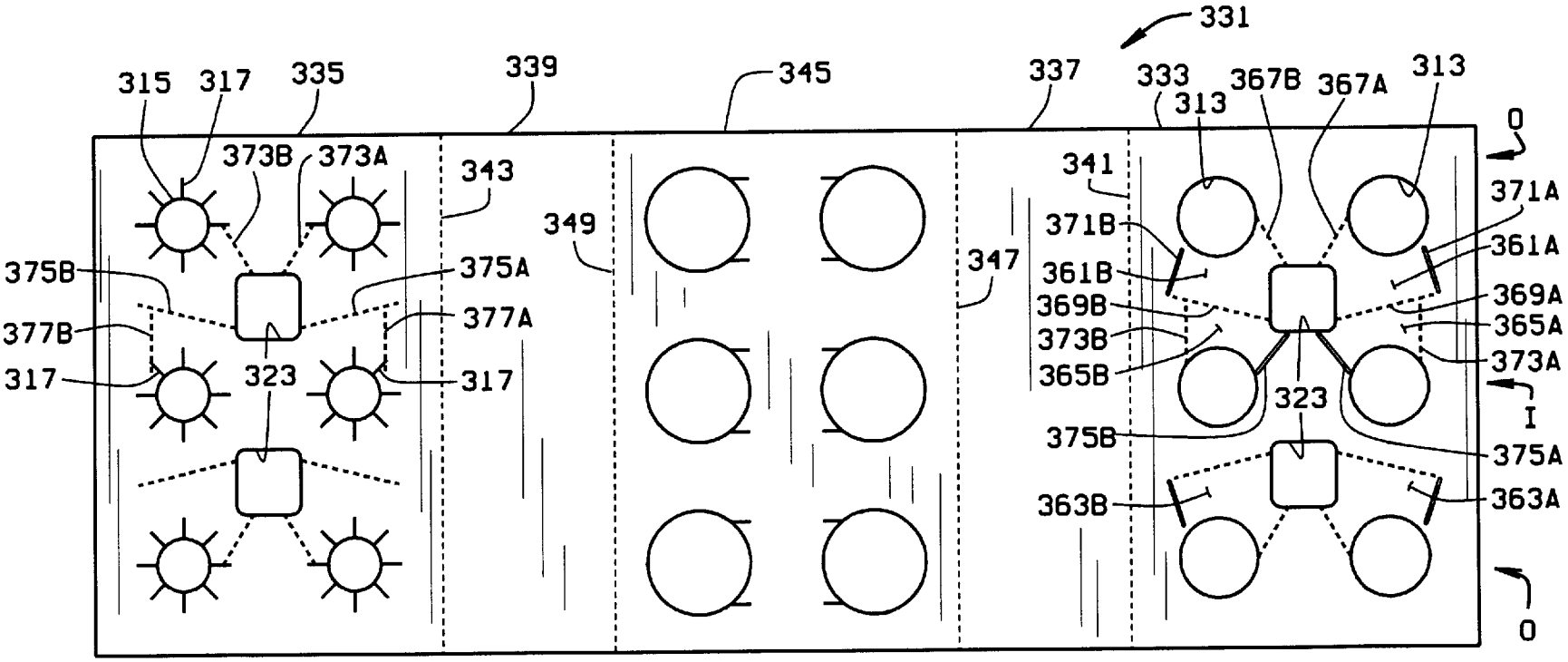
FIG. 12 is a top plan view of a blank for forming a carrier having another alternate release tab.
Figure 13:
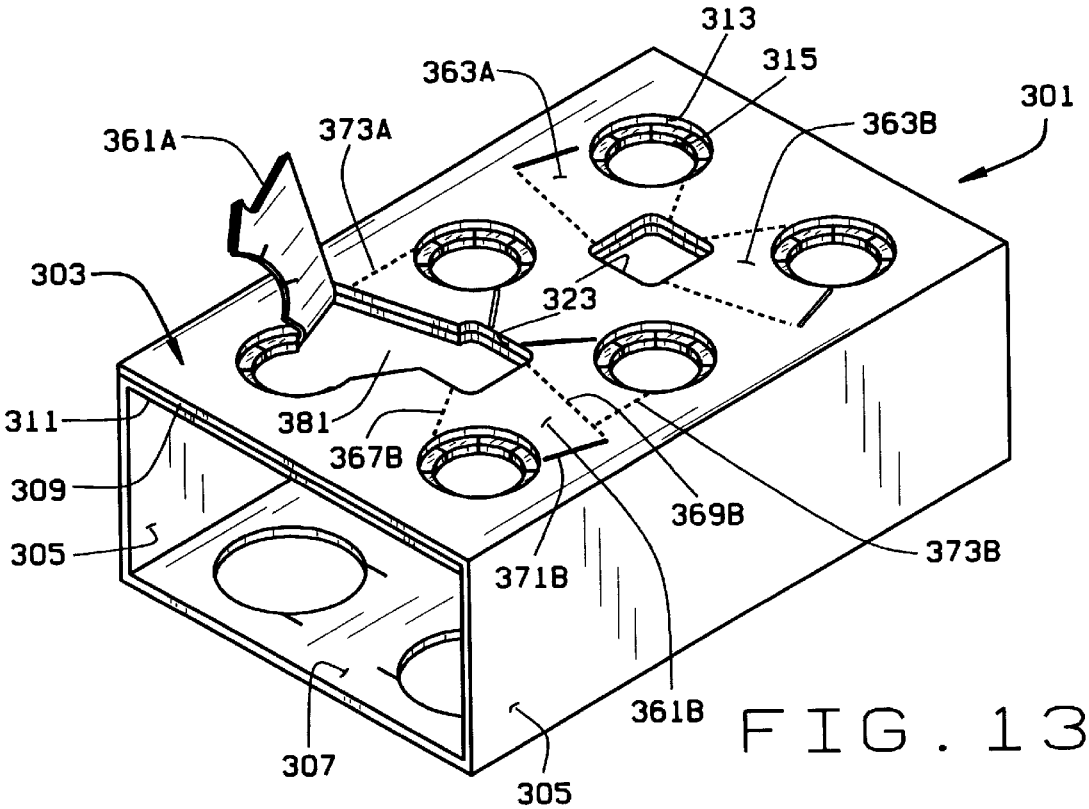
FIG. 13 is a perspective view of a carrier formed from the blank of FIG. 12, with one release tab pulled to allow a single bottle to be removed from the carrier.
Figure 14:
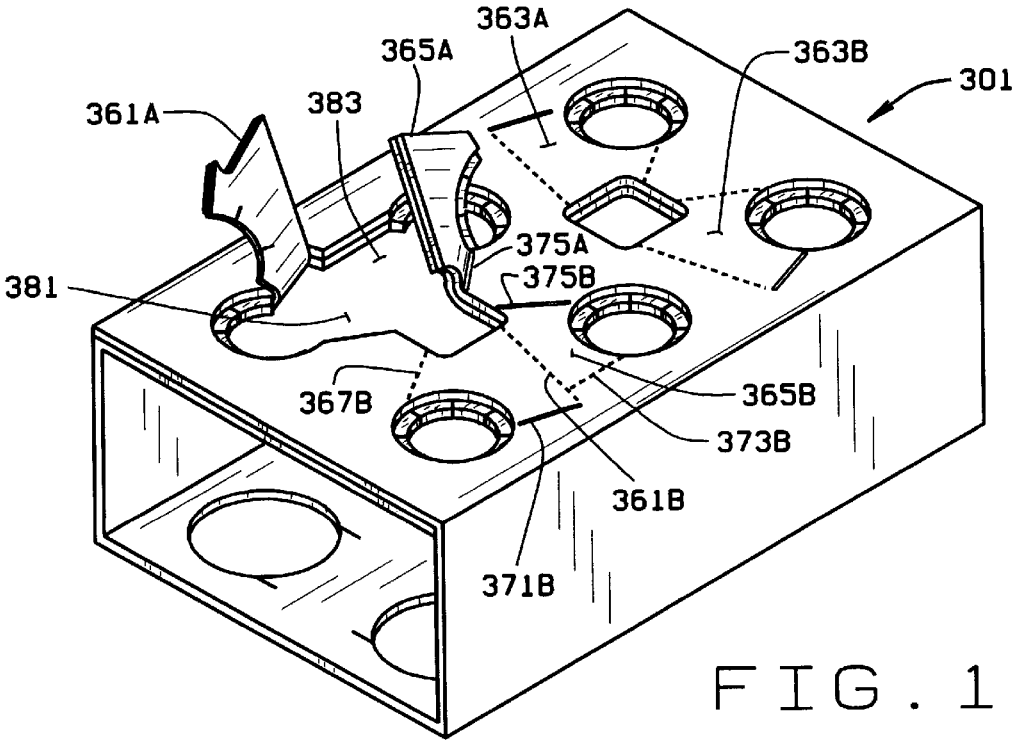
FIG. 14 is a perspective view of the carrier formed from the blank of FIG. 12, with two release tabs pulled.

A carrier 301 with a second alternative release tab arrangement is shown in FIGS. 13 and 14. The blank 331 from which the carrier 301 is made is shown in FIG. 12. Carrier 301 is substantially similar to the carrier 1 of FIG. 1 and includes a top panel 303, side panels 305, and a bottom panel 307. The top panel 303 is made from a top ply 309 and a bottom ply 311. The top ply includes a plurality of container surrounding apertures 313, and the bottom ply includes a plurality of container receiving apertures 315. Tab forming slits 317 extend from the container receiving apertures 315. The apertures 313 and 315, and the slits 317 are substantially identical to the apertures 13 and 15, and the slits 17 of the carrier 1 of FIG. 1, and will not be further described.

The blank 331, like the blank 31 of FIG. 4, includes two end sections 333 and 335 which form the top and second plies 309 and 311, respectively, of the top panel 303 are made. Blank sections 337 and 339 are hingedly connected to sections 333 and 335, respectively, and form side panels 305 of the carrier 301. The sections 337 and 339 are separated from the sections 333 and 335 by fold lines 341 and 343. A center section 345 is hingedly connected to the sections 337 and 339 along fold lines 347 and 349 to define the bottom panel 307 of the carrier 301.

The carrier 301 includes release tabs which open up the apertures in the top panel one at a time, rather than two at a time, as do the release tabs of the carriers 1, 101, and 201. As with the release tabs 261–265 of carrier 201, the release tabs of carrier 301 create an opening between one of the finger openings and a selected aperture in the top panel through which the neck of the bottle can pass. The release tabs essentially comprise two sets of release tabs. The first set includes release tabs 361A,B and 363A,B which open the apertures in the outer row O of the carrier 301. The second set of release tabs comprise tabs 365A,B which open the apertures in the inner row I of the carrier 301.

The tabs 361A,B are defined by tear lines 367A,B in the top panel 309 which extend diagonally from an edge (preferably an axial outer edge) of the finger hole 323 to one of the container surrounding apertures 313 in the outer row O of apertures. The tear lines 367A,B form an acute angle of about 30° with an axial center line of the carrier top panel 303. The tear lines 367A,B, if extended, would define secants with the apertures 315. A second set of tear lines 369A,B extend from an edge of the finger hole 323 towards the side 5 of the carrier. The tear lines 369A,B form an angle of about 75°–80° with the axial center line of the top panel 303. The tear lines 369A,B end at a point which falls generally on a line which forms a tangent with the container receiving apertures 315, the end point of the tear lines 369A,B being spaced from the aperture 315. Fold lines 371A,B extend from the aperture 315 to the tear lines 369A,B. The fold lines 369A,B form an angle of about 85° with the tear lines 369A,B. A first end of the fold lines 371A,B are spaced slightly from the aperture 315. The other end of the fold line substantially intersects the tear lines 369A,B.

In the second ply 311 (the blank portion 335), the tabs 361A,B are defined by tear lines 373A,B and 375A,B which directly underlie the tear lines 367A,B and 369A,B when the carrier 301 is formed. The fold lines 373A,B extend from the finger hole 323 and intersect one of the tab forming slits 317 at a point spaced from the edge of the respective container receiving aperture 315. There is no fold line formed in the second ply.

The tabs 363A,B are identical the tabs 361A,B. These tabs will thus not be further described.

The tabs 365A,B which open the apertures in the inner row O of apertures is defined by the tear lines 369A,B, tear lines 373A,B, and fold lines 375A,B in the top ply 309. The tear lines 373A,B extend between the apertures 313 in the inner row I and the tear lines 369A,B and are generally parallel to the edge between the top panel 303 and the side panel 305. The tear lines 373A,B, if extended, would form a secant with the inner row apertures 313 between the diameter of the aperture and the edge of the aperture that is closest to the side panel 305, the secant being closer to the side panel than to the diameter of the aperture 313. The fold lines 375A,B extend diagonally between the finger hole 323 and the inner row apertures 313, and form an angle of about 40° with the axial center line of the carrier top panel 303.

As with the tabs 361A,B, the tabs 365A,B is defined by corresponding tear lines 377A,B in the bottom ply 311. The tear lines 377A,B extend from the tear lines 375A,B towards the inner row container receiving apertures 315 in a direction generally parallel to the edge or side panel 305 of the carrier 301. The tear lines 377A,B do not intersect the apertures 315. Rather, they intersect the tab forming slits 317, preferably at an end of the slit. Thus, one end of the tear lines 377A,B intersect the slits 317 and the other end of the tear lines 377A,B intersect the tear lines 375A,B. The intersection between the tearlines 377A,B and 375A,B can be spaced inwardly from the end of the tear lines 375A,B. There are preferably no fold lines in the second ply 311 of the carrier 301.

The operation of the release tabs is shown in FIGS. 13 and 14. Initially, the tab 361A is opened by pulling from the finger hold 323 upwardly, to open the carrier along the tear lines 367A and 369A. The fold line 361A provides a hinge point for the tab to prevent the tab from being opened too far and to help prevent the carrier from being ripped or torn beyond the tear line 369B. This will create an opening 381 between the outer row apertures and the finger hole. To remove a bottle, the bottle is rotated in the carrier so that the neck of the bottle passes through the opening 381. With the neck of the bottle in the opening 381, the bottle can simply be slid through the openings in the carrier bottom panel.

The inner row apertures can only be opened after the corresponding outer row aperture has been opened. To open the tap 365A, the tab is grasped from the opening 381 and pulled upwardly. This will cause the carrier top panel to tear along the tear line 373A and to bend along the fold line 375A to form an opening 383 (FIG. 14) which opens from the inner row aperture into the opening 381. This allows the bottle neck to be rotated from the inner row aperture into or through the opening s 383 and 381. Once the neck of the bottle has been freed from the apertures, the bottle may be easily pulled through the bottom of the carrier.

As with the carrier 201, none of the tear lines which intersect the finger holes 323 extend generally parallel to the axis of the carrier. Thus, the fact that the tear lines in the top and bottom panel correspond to each other and directly overlie each other does not affect the strength of the top panel. This carrier 301 has the further advantage that there are not tear lines which extend from the finger holes 323 towards the inner row apertures.

In view of the above, it will be seen that the several objects and advantages of the present invention have been achieved and other advantageous results have been obtained.

As various changes could be made in the above constructions without departing from the scope of the invention, it is intended that all matter contained in the above description or shown in the accompanying drawings shall be interpreted as illustrative and not in a limiting sense. For example, although there is a single circular bottom panel aperture for each bottle B, the bottom panel apertures can be made elongate, such that the aperture extends between the two columns of bottles, to receive two bottles. This example is merely illustrative.

It is claimed:

1. A carrier for holding and transporting a plurality of bottles; the bottles each including a bottle body, a neck extending upwardly from said bottle body, a mouth at a top of the neck, and a take-out bead on said neck below said mouth, said take-out bead having a lower surface defining a chime at a point where said take-out bead lower surface intersects said neck; said carrier being generally quadrilateral in vertical cross-section; said carrier including:

a top panel, a bottom panel spaced from said top panel, and two side panels extending between said top and bottom panels, said panels being operatively connected to define a sleeve;

said top panel having at least a top ply and a second ply; said top ply defining a plurality of surrounding apertures through which said bottle necks extend, said second ply defining a plurality of container receiving apertures formed concentrically with and having a diameter smaller than said surrounding apertures of said top ply, said second ply including a plurality of slits extending from an edge of said container receiving apertures to define a plurality of tabs around said container receiving apertures;

said bottom panel having continuous and uninterrupted edges extending between said side panels and a plurality of apertures substantially concentric with said surrounding apertures and said container receiving apertures of said top panel; at least one of said bottom panel apertures frictionally engaging a surface of said bottles when bottles are placed in said carrier and which force increases when said carrier is lifted;

said side panels having a height such that at least one of said top panel and said bottom panel is placed in tension when said bottles are placed in said carrier, such that an arc is induced in said one of said top panel and said bottom panel when said bottles are inserted in said carrier;

a release mechanism including a tear strip in said top panel operable to effectively open at least one of said apertures in said top panel of said carrier and at least one slit extending from each of said bottom panel apertures to facilitate withdrawal of bottles from said carrier.

2. The carrier of claim 1 wherein said apertures are spaced apart to define a gap between the bottle bodies.

3. The carrier of claim 1 wherein said side panels are sized such that an arc is induced in the other of said top panel and said bottom panel when bottles are placed in said carrier, said arc in said bottom panel being an upwardly directed arc, and the arc in said top panel being a downwardly directed arc.

4. The carrier of claim 3 wherein said side panels are placed in compression when said carrier is applied to a group of bottles to form a package.

5. The carrier of claim 4 wherein when said package is lifted, the compression of said side panels increases.

6. The carrier of claim 1 wherein said container receiving apertures, said surrounding apertures, and said bottom panel apertures are formed in an array of at least two spaced apart rows, each said row having outer apertures spaced from edges of said carrier top panel; said release mechanism including:

a first pair of tear lines in said top panel second ply extending from a first edge of said top panel second ply to a first of said slits of a first of said outer container receiving apertures;

a second pair of tear lines in said top panel second ply extending from a second edge of said second ply opposite said first edge to a first of said slits of a second of said outer container receiving apertures; said pairs of tear lines including two spaced apart tear lines to define two tear strips extending between said container receiving apertures; and a first pair of tear lines and a second pair of tear lines in said top panel first ply, said first ply tear lines corresponding to said tear lines of said top panel second ply to define two tear strips extending between said container receiving apertures;

whereby, when a selected one of said tear strips is pulled, the container receiving apertures and the surrounding apertures adjacent said selected tear strip are opened sufficiently to allow the neck of a bottle to extend into the space between the apertures.

7. The carrier of claim 6 wherein the tear lines in one of the top and second plies are generally parallel to each other and the tear lines in the other of the top and second plies are angled relative to each other, the tear lines of the top ply being at least partially off-set from the tear lines of the second ply.

8. The carrier of claim 7 wherein said tear lines angled relative to each other have first ends at the edge of said carrier and second ends adjacent the apertures in the top panel, said first ends of said tear line being closer together than the second ends of said tear lines.

9. The carrier of claim 8 wherein said angled tear lines are in said second ply of said top panel and said parallel tear lines are in said top ply of said top panel.

10. The carrier of claim 6 including a third, inner, row of apertures between said outer rows of apertures, said release mechanism including a third pair of tear lines in said top panel second ply extending from a second slit of one of said outer surrounding apertures to a first slit of an inner surrounding aperture; and a third pair of tear lines in said top panel first ply corresponding to said third pair of tear lines in said second ply.

11. The carrier of claim 10 wherein the tear lines of said third pair of tear lines in one of said top ply and said second ply include a first leg extending diagonally from an outer aperture of said top panel and a second leg that extends diagonally from an inner aperture of said top panel, said first and second legs being joined at an apex, such that said tear lines of said third pair of tear lines define a triangle, said triangle pointing away from a center of said top panel; said third pair of tear lines of said top ply being offset from said third pair of tear lines from said second ply.

12. The carrier of claim 11 wherein the said triangles of said tear lines of said third pair of tear lines are symmetrical with each other about the center of said top panel.

13. The carrier of claim 12 wherein the tear lines of said third pair of tear lines in the other of said top ply and second ply are generally parallel to each other.

14. The carrier of claim 13 wherein the triangular shaped tear lines of the third pair of tear lines are in the top ply of the top panel and the parallel tear lines of the third pair of tear lines are in the second ply of the top panel.

15. The carrier of claim 10 wherein said tear strips of said first and second ply are secured together, said tear strips each being symmetrical about a center line of said tear strips.

16. The carrier of claim 10 wherein said release mechanism includes fold lines extending between the second slits of at least one of said outer apertures and a fold line extending between second slits of said inner apertures, said fold lines being formed on at least one of said top and second ply of said top panel.

17. The carrier of claim 1 wherein said carrier includes a finger hole in said top panel; said container receiving apertures, said surrounding apertures, and said bottom panel apertures are formed in an array of at least two spaced apart rows, said finger hole being positioned between said rows of apertures; said release mechanism including tear lines in said top panel, said tear lines extending from said finger hole to each of the top panel apertures adjacent the finger hole; said tear strips being defined by two adjacent tear lines.

18. The carrier of claim 17 wherein including a fold line extending across the carrier top panel in a direction generally perpendicular to an axis of the tear strip.

19. The carrier of claim 1 wherein said release mechanism is operable to open one top panel aperture at a time to release bottles from the carrier one at a time, said release mechanism including an individual tear strip for each aperture of said top panel.

20. The carrier of claim 19 wherein said carrier includes top panel apertures define an array of at least two rows by two columns, said carrier including a finger opening positioned between said rows and columns of said carrier; said release mechanism including a first pair of tear strips and a second pair of tear strips; said tear strips of said first and second pair of tear strips each being defined by a first tear line extending diagonally from said finger hole toward an end of said carrier to at least tangentially intersect an aperture of said carrier and a second tear line which extends from said finger hole toward a side of said carrier; said second tear line being sufficiently long, such that when a selected tear strip is pulled, an opening is formed between a selected aperture and said finger hole which is sufficiently wide for the neck of a bottle to pass through.

21. The carrier of claim 20 including a fold line in said top panel which extends generally from said second tear line to the respective aperture.

22. The carrier of claim 21 wherein the fold line is substantially perpendicular to the second tear line.

23. The carrier of claim 20 including a third row of apertures between said first and second row of apertures, the release mechanism including a third pair of tear strips extending between said apertures of said third row and the finger hole, each tear strip of the third pair of tear strips being defined by said second tear line and a third tear line extending from said aperture of said third row to said second tear line.

24. The carrier of claim 23 wherein said third tear line is generally parallel to a side edge of said carrier.

25. The carrier of claim 23 including a fold line for each of said tear strips of said third pair of tear strips, said fold line extending diagonally between said finger hole and said apertures.

26. The carrier of claim 1 wherein said at least one slit in said bottom panel is sufficiently long to overcome the friction grip of the carrier on the bottle.

27. The carrier of claim 26 wherein said at least one slit in said bottom panel includes two spaced apart slits, the lip formed by said spaced apart slits bending when a bottle is removed from said carrier.

28. The carrier of claim 26 wherein said at least one slit in said bottom panel is less then ½".

29. A carrier for holding and transporting a plurality of bottles; said bottles each including a bottle body, a neck extending upwardly from said bottle body, a mouth at a top of the neck, and a take-out bead on said neck below said mouth, said take-out bead having a lower surface defining a chime at a point where said take-out bead lower surface intersects said neck; said carrier being generally quadrilateral in vertical cross-section; said carrier including:

a top panel, a bottom panel spaced from said top panel, and two side panels extending between said top and bottom panels, said panels being operatively connected to define a sleeve;

said top panel having apertures through which said bottle necks extend and a plurality of slits extending from an edge of said container receiving apertures to define a plurality of tabs around said apertures;

said bottom panel having continuous and uninterrupted edges extending between said side panels and a plurality of apertures concentric with said top panel apertures;

said top panel apertures and bottom panel apertures being formed in an array having at least two columns of at least two spaced apart rows, each said row having outer apertures spaced from edges of said carrier; said release mechanism including:

a first pair of tear lines in said top panel extending from a first edge of said top panel to a first of said slits of a first of said outer surrounding apertures;

a second pair of tear lines in said top panel extending from a second edge of said top panel opposite said first edge to a first of said slits of a second of said outer container surrounding apertures;

said pairs of tear lines including two spaced apart tear lines which define tear strips extending between said top panel apertures, such that when one of said strips is pulled, the strip forms a space between said columns of apertures in said top panel and a gap in said top panel apertures which place said top panel apertures in communication with said space.

30. The carrier of claim 29 wherein said array of apertures in said top and bottom panels includes an inner row of apertures positioned between said outer rows of apertures, said release mechanism including a third pair of tear lines in said top panel extending from a second slit of one of said outer surrounding apertures to a first slit of an inner surrounding aperture.

31. The carrier of claim 29 including means for preventing the elongation of said top panel slits when said carrier is applied to a group of bottles.

32. The carrier of claim 31 wherein said top panel has at least a top ply and a second ply; said top ply defining a plurality of surrounding apertures through which said bottle necks extend when said carrier is applied to bottles, said second ply defining a plurality of container receiving apertures formed concentrically with and having a diameter smaller than said surrounding apertures of said top ply; said top panel apertures comprising said surrounding apertures of said top ply and said container receiving aperture of said second ply; said slits extending from an edge of said container receiving apertures of said second ply to define said tabs around said container receiving apertures; said slit elongation means comprising said surrounding apertures of said top ply, said surrounding apertures defining a hinge point for said tabs to prevent elongation of said tab defining slits.

33. The carrier of claim 32 wherein said pairs of tear lines are formed in both said top panel second ply and said top panel first ply; said tear lines said top panel first ply corresponding to said tear lines in said top panel second ply, such that said tear strip extends through said top panel.

34. The carrier of claim 33 wherein the tear lines in one of the top and second plies are generally parallel to each other and the tear lines in the other of the top and second plies are angled relative to each other, the tear lines of the top ply being at least partially off-set from the tear lines of the second ply.

35. The carrier of claim 34 wherein said tear lines angled relative to each other have first ends at the edge of said carrier and second ends adjacent the apertures in the top panel, said first ends of said tear line being closer together than the second ends of said tear lines.

36. The carrier of claim 35 wherein said angled tear lines are in said second ply of said top panel and said parallel tear lines are in said top ply of said top panel.

37. The carrier of claim 33 wherein said release mechanism includes fold lines extending between second slits of at least one of said outer apertures and a fold line extending between second slits of said inner apertures.

38. The carrier of claim 33 including a third, inner, row of apertures between said outer rows of apertures, said release mechanism including a third pair of tear lines in said top panel second ply extending from a second slit of one of said outer surrounding apertures to a first slit of an inner surrounding aperture; and a third pair of tear lines in said top panel first ply corresponding to said third pair of tear lines in said second ply.

39. The carrier of claim 38 wherein the tear lines of said third pair of tear lines in one of said top ply and said second ply include a first leg extending diagonally from an outer aperture of said top panel and a second leg that extends diagonally from an inner aperture of said top panel, said first and second legs being joined at an apex, such that said tear lines of said third pair of tear lines define a triangle, said triangle pointing away from a center of said top panel; said third pair of tear lines of said top ply being offset from said third pair of tear lines from said second ply.

40. The carrier of claim 39 wherein the said triangles of said tear lines of said third pair of tear lines are symmetrical with each other about the center of said top panel.

41. The carrier of claim 40 wherein the tear lines of said third pair of tear lines in the other of said top ply and second ply are generally parallel to each other.

42. The carrier of claim 41 wherein the triangular shaped tear lines of the third pair of tear lines are in the top ply of the top panel and the parallel tear lines of the third pair of tear lines are in the second ply of the top panel.

43. The carrier of claim 29 including at least one slit extending inwardly from each of said bottom panel apertures, said at least one bottom panel slit forming a lip in said bottom panel to facilitate withdrawal of bottles from said carrier.

44. The carrier of claim 43 wherein said at least one slit includes two spaced apart slits, the lip formed by said spaced apart slits bending when a bottle is removed from said carrier.

45. The carrier of claim 44 wherein said at least one slit is sufficiently long to overcome the friction grip of the carrier on the bottle.

46. The carrier of claim 45 wherein said at least one slit is less then ½".

* * * * *